US010556774B2

(12) United States Patent
Villa

(10) Patent No.: US 10,556,774 B2
(45) Date of Patent: Feb. 11, 2020

(54) METHOD AND ARRANGEMENT FOR DETERMINING ELEVATOR DATA BASED ON THE POSITION OF AN ELEVATOR CAR

(71) Applicant: INVENTIO AG, Hergiswil (CH)

(72) Inventor: Valerio Villa, Gironico (IT)

(73) Assignee: INVENTIO AG, Hergiswil (CH)

( * ) Notice: Subject to any disclaimer, the term of this patent is extended or adjusted under 35 U.S.C. 154(b) by 408 days.

(21) Appl. No.: 15/506,764

(22) PCT Filed: Aug. 27, 2015

(86) PCT No.: PCT/EP2015/069702
§ 371 (c)(1),
(2) Date: Feb. 27, 2017

(87) PCT Pub. No.: WO2016/030487
PCT Pub. Date: Mar. 3, 2016

(65) Prior Publication Data

US 2017/0253461 A1 Sep. 7, 2017

(30) Foreign Application Priority Data

Aug. 29, 2014 (EP) ..... 14182871

(51) Int. Cl.

| | |
|---|---|
| ***B66B 1/34*** | (2006.01) |
| ***B66B 1/44*** | (2006.01) |
| ***B66B 1/28*** | (2006.01) |
| ***B66B 5/00*** | (2006.01) |
| ***B66B 9/00*** | (2006.01) |

(52) U.S. Cl.
CPC ..... *B66B 1/44* (2013.01); *B66B 1/28* (2013.01); *B66B 1/3492* (2013.01); *B66B 5/0018* (2013.01); *B66B 9/00* (2013.01)

(58) Field of Classification Search
CPC ..... B66B 1/44; B66B 1/28; B66B 1/3492; B66B 5/0018; B66B 9/00
USPC ..... 187/247, 277, 282, 283, 284, 291, 391, 187/393, 394
See application file for complete search history.

(56) References Cited

U.S. PATENT DOCUMENTS 4,245,721 A 1/1981 Masel
5,631,452 A * 5/1997 Jamieson ..... B66B 1/3492 187/391

(Continued)

FOREIGN PATENT DOCUMENTS

GB 2255246 A 10/1992
WO 2012032020 A1 3/2012

*Primary Examiner* — Anthony J Salata
(74) *Attorney, Agent, or Firm* — William J. Clemens; Shumaker, Loop & Kendrick, LLP

(57) ABSTRACT

A method and an arrangement for determining elevator data based on the position of an elevator car of an elevator system includes the elevator car having a flag reading sensor, the elevator car being movably arranged in a hoistway and can be moved by a drive with a suspension rope over a traction sheave, and the elevator car can be stopped at a plurality of stopping positions of the hoistway. Each stopping position has a flag marker with a flag height. Movement of the elevator car is determined by a control unit connected to an encoder at the traction sheave. When leaving a stopping position, the travelled distance of the elevator car between the stopping position and a flag edge is measured and a stopping inaccuracy is determined by the control unit.

16 Claims, 2 Drawing Sheets

(56) References Cited

U.S. PATENT DOCUMENTS

| | | | | |
|---|---|---|---|---|
| 5,659,159 | A * | 8/1997 | Koopman, Jr. | B66B 1/40 187/291 |
| 5,677,519 | A * | 10/1997 | Herkel | B66B 1/3492 187/283 |
| 5,747,755 | A * | 5/1998 | Coste | B66B 1/3492 187/393 |
| 5,783,783 | A * | 7/1998 | Toutaoui | B66B 1/3492 187/294 |
| 5,869,795 | A * | 2/1999 | Miyazawa | B66B 1/44 187/284 |
| 6,026,935 | A | 2/2000 | Koh | |
| 6,202,796 | B1 | 3/2001 | Lee | |
| 6,435,315 | B1 * | 8/2002 | Zaharia | B66B 1/3492 187/394 |
| 6,526,368 | B1 * | 2/2003 | Coste | B66B 1/40 187/284 |
| 7,597,176 | B2 * | 10/2009 | Zaharia | B66B 1/3492 187/394 |
| 9,809,419 | B2 * | 11/2017 | Otsuka | B66B 1/3492 |
| 2012/0222917 | A1 | 9/2012 | Villa et al. | |

* cited by examiner

17
ENCODER
12
8
MOTOR
16,10
9
6
1
CONTROL UNIT
STORAGE
LOAD SENSOR
7
5
18
11
3
CAR
7'
3.1
18
2
7''
18
4
F
COUNTERWEIGHT 18
15
13
14
13 FLAG MARKER
15 FLAG READING SENSOR

METHOD AND ARRANGEMENT FOR DETERMINING ELEVATOR DATA BASED ON THE POSITION OF AN ELEVATOR CAR

FIELD

The invention relates to a method and an arrangement for determining elevator data based on the position of an elevator car determined with a door zone sensor and door zone markers.

BACKGROUND

The position of an elevator car in an elevator system is best determined directly using a sensor or encoder which is directly linked to the elevator car. This is however expensive since it is necessary to provide a supplementary arrangement for measuring the position of the elevator car.

Another approach is, as described exemplarily in the patent document WO 2012/032020, to use an incremental rotary encoder connected with a pulley of the elevator system to determine the position of the car.

This method is not particularly satisfying, since the traction and suspension means of the elevator may stretch over time and due to the loading of the car, leading to a drift of the car position and consequently to stopping inaccuracy of the car. Slipping of the traction means may also cause inaccuracy in the determination of the position of the car.

In addition, when a car is reaching stopping at a floor, the car may be too fast or too slow. This may impede the rotary encoder of the drive or the control unit of the elevator system to properly control the elevator system and stop the elevator car such as the flag reading sensor lies in the middle of the flag marking, as suggested by the patent document WO 2012/032020. This also leads to a stopping inaccuracy of the car such that a step is present between the car floor and the building floor, said step being e.g. potentially dangerous for passengers of the elevator car.

SUMMARY

It is therefore aim of the present invention to provide a method and an arrangement for the determination of elevator data based on the position of an elevator car by which stopping inaccuracy, drifting and/or slippage of the elevator car may be determined in a reliable way without the need of additional cost and maintenance intensive components.

The method according to the present invention is performed in an elevator system comprising an elevator car with a flag reading sensor. The elevator car is movably arranged in a hoistway and can be moved by a drive over a traction sheave and at least one suspension means along the hoistway can be stopped at a plurality of stopping positions of the hoistway. Alternatively, the elevator system can be operated by means of an hydraulic traction means. Each stopping position has a flag marker with a known flag height F. The movement of the elevator car is determined by a control unit connected to an encoder.

Means for measuring movements of the elevator car can be preferably an encoder. The encoder is preferably a rotary encoder, in particular an incremental rotary encoder, and is preferably coupled to the traction sheave.

In order to indirectly determine the stopping inaccuracy at the stopping position, the travelled distance D of the elevator car between the stopping position and the flag edge passed by the flag reading sensor when the elevator car is leaving the stopping position for a subsequent ride is measured by the control unit. This is done using the signals of the encoder and the flag reading sensor. Alternatively other door zone sensors may be used instead of said flag reading sensor.

Instead of flag markers other door zone markers are also conceivable. Door zone markers may be, for example, stripes of reflective tape or magnet bands each having a given height which can be sensed or read by a magnetic sensor.

As a next step, the stopping inaccuracy I can be determined by taking into consideration the value F/2−D. With this value or just with the value for D it can be determined whether the stop is over or below the middle of the flag.

Preferably, the stopping inaccuracy I is determined according to I=ABS(F/2−D), wherein ABS is the absolute value of the difference between the half of the flag height F and the measured travelled distance D.

It is assumed that, as cited above, the control unit controls the elevator car such that it stops with the flag reading sensor in the middle of the flag. If this is not the case, this should be taken into consideration when determining the stopping inaccuracy I. It is further assumed that the spatial relationships between position of the flag markers and the building floor as well as the relationship between flag reading sensor as the preferred door zone sensor, and car floor are not variable.

Preferably, the measured stopping inaccuracy I is taken into account when stopping the elevator car during a further ride.

This is done preferably by storing the determined stopping inaccuracy I, preferably with other data related to the elevator such as a load of the elevator car, the ride path (from the stopping position n to the stopping position m) as well as a time stamp of the ride, in a storage means connected to the control unit. By doing this, the control unit can also continuously monitor the evolution of the stopping inaccuracy (and/or based on the measured travelled distances D) and based on the determined stopping inaccuracies I (and/or based on the measured travelled distances D) determine a drift or slippage of the elevator car by taking into account the time interval between car rides. Whether drift issues occur or not can be determined when subsequent trips of the elevator car are done right after the former one. Whether slippage issues occur or not can be determined when subsequent trips of the elevator car are done after a long standstill period (e.g. night sleep of the car). So the respective data can be used as an example for determining if the suspension means have reached a maximal allowed stretching over time or after a long standstill period, and/or for determine if slipping of the suspension means occurs. If the slipping exceeds a predefined threshold value, then may be an auto-call of service is triggered.

It is therefore furthermore possible to correct the stopping method of the elevator car in order to avoid a step between the elevator floor and the building floor. Preferred storage means are non-volatile computer storage means such as hard disk drives, solid state drives, memory cards, etc. The storage means are not necessarily physically present in the elevator system but may be remote arranged and connected to the control unit via a data connection, such as the internet.

A possible way to determine whether a drift occurred is to evaluate if the subsequent trip is done right after the former one or the two trips are separated by a long standstill time. By making separate statistics for subsequent trips and trips separated by long time intervals and by analyzing these statistics will allow one to decide if the elevator had drifting issues, slippage issues or both.

Preferably, the travelled distance D and/or the stopping inaccuracy I of the elevator car is determined and stored for every of the plurality of the stopping positions. This takes into account that a stopping inaccuracy, which may be caused by stretching of the suspension means may be proportional to the length of the suspension means suspending the car. In other words, stretching of the suspension means is more pronounced when the suspension means are long, meaning that the elevator car is at a low stopping position. The stopping inaccuracy I can therefore be determined for each of the stopping positions such that a correction of the stopping method can be performed for every stopping position separately.

Preferably, the travelled distance D and/or the stopping inaccuracy I of the elevator car is determined and stored for every direction of travel of the elevator car. This takes into account that the travelled distance and/or the stopping inaccuracy at a given stopping position may be different depending of the travelling direction (e.g. upward or downward) of the elevator car. Preferably, this is done, as cited above, for each stopping position separately.

Preferably, the travelled distance D and/or the stopping inaccuracy I of the elevator car is only determined if a load L of the elevator car determined by a load sensor is within a given range. Since stopping accuracy may be related to the load L of the elevator car, it is useful to compare the stopping inaccuracy only if the load L of the elevator car is within a certain range of comparable loads. As an alternative, the stopping inaccuracy I can be determined and stored together with the measured load L in order to allow a correlation between stopping inaccuracy I and load L as well as other factors such speed of the car etc. as described above.

Preferably, the given load range is calculated according to L±x, wherein x is a factor dependent on the elevator system, the elevator car and/or the suspension means type.

Preferably, the travelled distance D and/or the stopping inaccuracy I of the elevator car is only determined if an elevator car ride takes place within a given time interval t. Therefore, the method can be used to determine stopping inaccuracy I only if rides of the elevator car take place within a short period of time, while if the elevator car stands still for long periods, the stopping inaccuracy I is not determined or is not taken into consideration when correcting a stopping method. However, the value for D or for ABS(F/2−D) may be used with an elevator car that stands still for long periods in order to be able to determine whether drifting occurred or not. By making separate statistics for subsequent trips and trips separated by long times and by analyzing these statistics that will allow one to decide if the elevator has drifting issues, slippage issues or both.

The arrangement according to the invention comprises, for example, a flag reading sensor for an elevator car, flag markers with a flag height F for every of a plurality of stopping positions of a hoistway and means, typically an encoder, for measuring movement of the elevator car. The elevator car is movably arranged in the hoistway by means of at least one suspension means and a traction sheave coupled with a drive. The drive for moving the elevator car preferably is coupled to a traction sheave and at least one suspension means. The arrangement further comprises a control unit for controlling the elevator system connected to an encoder or other means for measuring movements of the elevator car. The control unit is able of measuring a travel distance D of the elevator car between the stopping position and a flag edge when the elevator car is leaving a stopping position by means of the encoder and the flag reading sensor and then can determine a stopping inaccuracy I or another parameter which refers to the position of an elevator car.

Preferably, the stopping inaccuracy is determined according to I=ABS(F/2−D), wherein ABS is the absolute value of the difference between the half of the flag height F and the measured travelled distance D.

A method as cited above is preferably used with the arrangement according to the present invention. Preferably, the encoder is a rotary encoder, in particular an incremental rotary encoder, preferably coupled to the traction sheave.

It is therefore possible to provide an accurate determination of stopping inaccuracy without the need of means for determining the position of the elevator car directly (e.g. without the need of a position encoder on the elevator car).

Preferably, the control unit is further connected to storage means for storing the determined stopping inaccuracy I.

Preferably, the control unit is further connected to a load sensor for measuring a load L of the elevator car.

As cited above regarding the method, the stopping inaccuracy may be stored in storage means in order to determine changes over time. This can be done taking into consideration other factors such as a direction of travel, a stopping position, a time between rides, a load L of the car etc.

DESCRIPTION OF THE DRAWINGS

Further advantages of the invention will be better understood with the aid of the following description together with the Figures. It is shown in.

DETAILED DESCRIPTION

Figures 1, 1A:
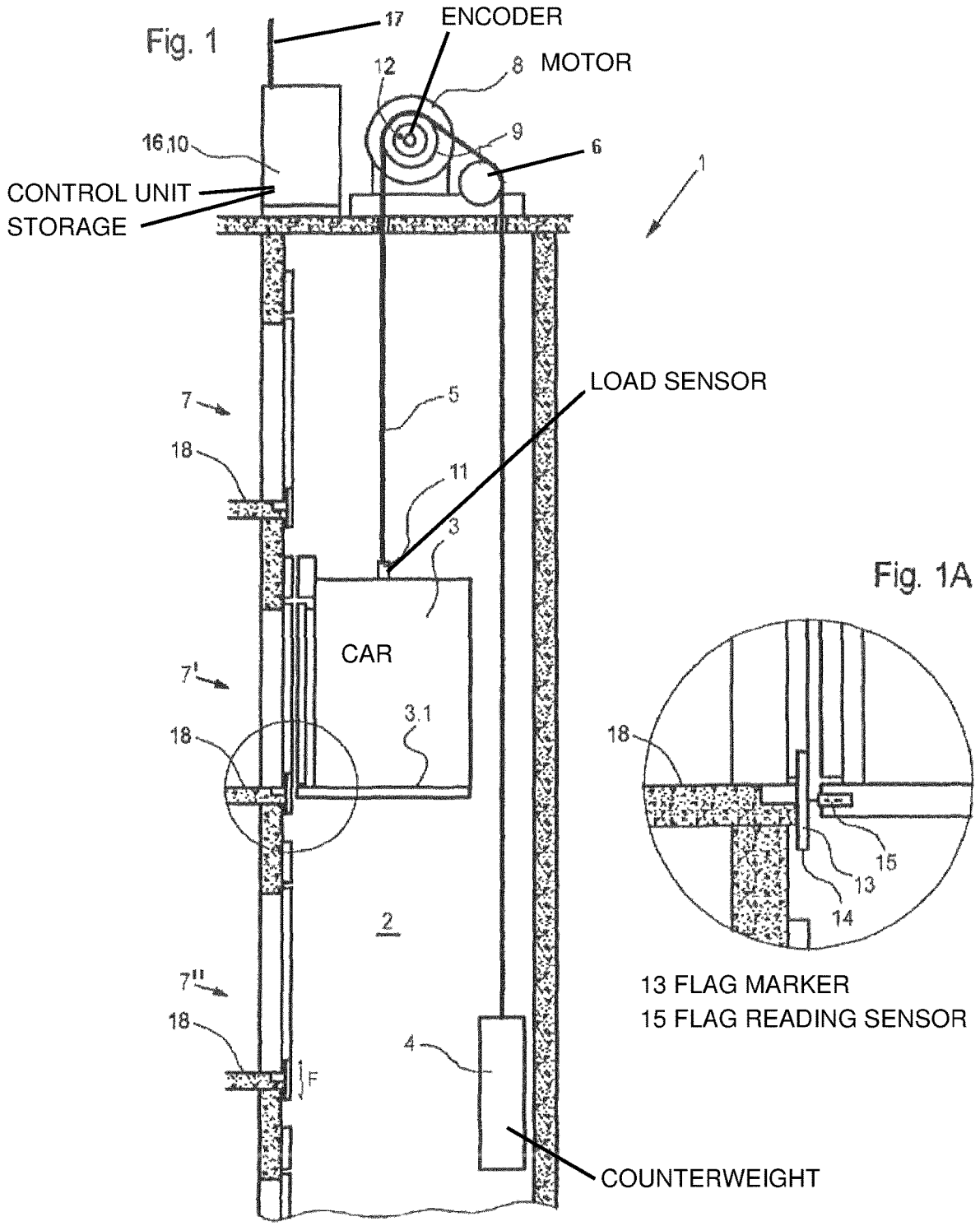
FIG. 1 a schematic view of an elevator system.
FIG. 1A a detailed view of the detail A of FIG. 1.

In FIG. 1 an elevator system 1 with a hoistway 2 is shown. An elevator car 3 and a counterweight 4 are movably arranged in the hoistway 2 and connected to each other by means of a suspension means, in this case a steel rope 5. The steel rope 5 is conducted over a pulley 6 and a traction sheave 9 connected to an electric motor 8. The traction sheave 9 has an incremental rotary encoder 12 connected to it in order to detect movement of the traction sheave 9 and therefore movement and direction of travel of the elevator car 3.

A control unit 10 is also present and is connected amongst others with the electric motor 8 and the incremental rotary encoder 12. A data connection 17 allows remote connection and/or diagnosis of the elevator system 1.

Each floor 7, 7' and 7" of the hoistway 2 has a building floor 18, which corresponds to a stopping position of the elevator car 3. Accordingly, a car floor 3.1 of the elevator car 3 is aligned with the respective building floor 18 when the elevator car 3 is standing still at a floor 7, 7' or 7". In FIG. 1, the elevator car 3 has stopped at floor 7'.

In order to correctly stop the car at the desired floor 7', every building floor 18 is marked with a flag marker 13 with a flag height F. However, it would also be conceivable to use other door zone markers or other markers in the hoistway. The elevator car 3 has a flag reading sensor 15 as a preferred example of a door zone sensor. Flag marker 13 and flag reading sensor 15 are arranged with respect to each other such that when the building floor 18 and the car floor 3.1 are perfectly aligned, this means that building floor 18 and car floor 3.1 are at the same height, the flag reading sensor is positioned exactly in the middle of the flag marker 13. In other words, the distance between the flag reading sensor 15 and a flag edge 14, in this case the lower flag edge, is exactly half of the height F of the flag marker 13.

When an elevator car 3 is moving to the desired floor 7', e.g. moving upwards, the control unit 10 can estimate the position of the elevator car by means of the incremental rotary encoder 12.

In addition, the flag reading sensor 15 may be used when passing a flag marker 13 to correct or increase the precision of the data from the rotary encoder 12.

When arriving at the desired floor 7', the flag reading sensor 15 detects the flag edge 14 and sends a signal to the control unit 10. The control unit 10 uses the rotary encoder 12 and the drive 8 to move the elevator car 3 for a further travel of half the height F of the flag marker 13 (F/2), such that the flag reading sensor 15 is exactly positioned in the middle of the flag marker 13 and the building floor 18 and the car floor 3.1 are aligned with each other.

Figure 2:
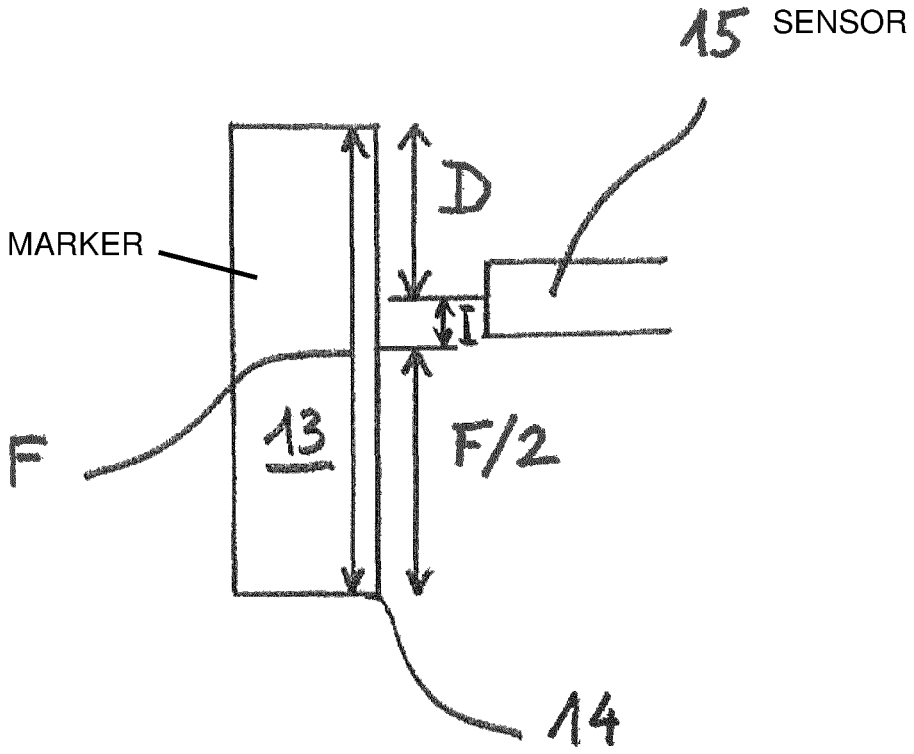
FIG. 2 a schematic view of the detail A of FIG. 1.

It is however possible that due to slipping or stretching of the steel rope 5 or due to wrong speed of the elevator car 3, that stopping does not occur at the desired stopping position. Such a case is schematically shown in FIG. 2.

The control unit 10 can determine this stopping inaccuracy in an indirect way when moving the car for a further ride.

If the elevator car 3 is moved upward within a given time gap t from the last ride, and the load L of the elevator car 3, measured by means of a load sensor 11, is within a given range L±x, the travelled distance D from start until the detected end of the flag marker 13 (in this case the upper flag edge) is measured by means of the rotary encoder 12. A stopping inaccuracy I is then determined according to I=(F/2−D). Taking into account the direction of travel of the elevator car 3, the control unit 10 can therefore determine if the car was positioned correctly during the last stop or if a step (upward or downward) was present between the building floor 18 and the car floor 3.1. In the configuration shown in FIG. 2, the car floor 3.1 would be higher than the building floor 7.

The determined stopping inaccuracy I is then used to correct a distance/speed profile used to control the elevator car in order to increase the stopping precision of the elevator car 3.

The determined stopping inaccuracy is preferably stored in a storage 16 of the control unit 10 and also used to determine if stopping inaccuracy of the elevator system 1 is increasing over time and thus detect a drift of the elevator car 3. The detected drifting may be then compared with a maximal drifting threshold, whereby if the detected drift is above the threshold, an alarm for a technician requesting inspection or the like may be generated, and sent to a maintenance center over the data connection 17. For determining a slippage only values for the travelled distance D and/or the stopping inaccuracy I of the elevator car 3 if an elevator car ride takes place exceeds a given time interval t two trips are separated by a long standstill time are used or taken into consideration for the determination of the slippage. This long time interval t can be 2 hours, preferably 4 hours or most preferably 6 hours (e.g. night sleep of the car).

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for determining elevator data based on a position of an elevator car of an elevator system, wherein the elevator car has a door zone sensor and is movably arranged in a hoistway, wherein the elevator car is moved by a drive with a traction sheave via a suspension means connected to the elevator car and can be stopped at a plurality of stopping positions of the hoistway, each stopping position having a door zone marker with a given height, and wherein movement of the elevator car is determined by a control unit connected to the drive and to an encoder at the traction sheave, comprising the steps of:

when the elevator car is leaving one of the stopping positions, a travelled distance of the elevator car between the one stopping position and an edge of the door zone marker at the one stopping position is measured by the control unit using the door zone sensor and the encoder;

an actual position parameter based on the travelled distance and the given height of the door zone marker at the one stopping position is determined by the control unit; and the control unit controls the movement of the elevator car in response to the actual position parameter.

2. The method according to claim 1 wherein the actual position parameter is a stopping inaccuracy that is determined by the control unit as an absolute value of a difference between half of the given height and the travelled distance.

3. The method according to claim 2 wherein the stopping inaccuracy is taken into account by the control unit when controlling a next stop of the elevator car.

4. The method according to claim 2 wherein for the one stopping position at least one of a plurality of the travelled distance and a plurality of the stopping inaccuracy over time are stored in a storage connected to the control unit and are used by the control unit to determine a drift or slippage of the elevator car.

5. The method according to claim 4 wherein at least one of the travelled distance and the stopping inaccuracy of the elevator car is determined and stored for each of the plurality of the stopping positions.

6. The method according to claim 4 wherein at least one of the travelled distance and the stopping inaccuracy of the elevator car is determined and stored for each direction of travel of the elevator car.

7. The method according to claim 2 wherein at least one of the travelled distance and the stopping inaccuracy of the elevator car is only determined if a load of the elevator car determined by a load sensor is within a given range.

8. The method according to claim 2 wherein for determining a drifting of the elevator car at least one of the travelled distance and the stopping inaccuracy of the elevator car is only determined if a trip of the elevator car takes place within a given time interval.

9. The method according to claim 2 wherein for determining a slippage of the elevator car at least one of the travelled distance and the stopping inaccuracy of the elevator car is only determined if a trip of the elevator car takes place after a given time interval.

10. An elevator system for performing the method according to claim 1 comprising:

the elevator car;

the hoistway;

the drive with the traction sheave and the suspension means connected to the elevator car for moving the elevator car to the plurality of stopping positions of the hoistway, each of the stopping positions having the door zone marker with the given height; and the control unit connected to the drive and to an encoder at the traction sheave for controlling the moving of the elevator car in the hoistway.

11. An arrangement for determining elevator data based on a position of an elevator car being movable in a hoistway by a drive, comprising:

a door zone sensor on the elevator car;

a door zone marker with a given height at a stopping position of the elevator car within the hoistway;

means for measuring movements of the elevator car in the hoistway; and a control unit connected to the drive for controlling the movement of the elevator car, the control unit being connected to the means for measuring movements and the door zone sensor for determining a travelled distance of the elevator car between the stopping position and an edge of the door zone marker when the elevator car is leaving the stopping position and for determining a stopping inaccuracy based on the travelled distance and the given height of the door zone marker.

12. The arrangement according to claim 11 wherein the control unit determines the stopping inaccuracy as an absolute value of a difference between half of the given height and the travelled distance.

13. The arrangement according to claim 11 including a storage connected to the control unit for storing the determined stopping inaccuracy.

14. The arrangement according to claim 11 including a load sensor connected to the control unit for measuring a load of the elevator car and wherein the control unit only determines the travelled distance or the stopping inaccuracy if the load measured by the load sensor is within a given range.

15. The arrangement according to claim 11 wherein the means for measuring movements of the elevator car is a rotary encoder coupled to a traction sheave of the drive.

16. An elevator system including the elevator car, the hoistway, the drive and the arrangement according to claim 11 further comprising:

at least another stopping position within the hoistway;

another door zone marker with the given height at the another stopping position; and wherein the control unit determines another travelled distance between the another stopping position and an edge of the another door zone marker when the elevator car is leaving the another stopping position and determines another stopping inaccuracy based upon the another travelled distance and the given height of the another door zone marker.

* * * * *